US007187757B2

(12) United States Patent
Saint-Martin et al.

(10) Patent No.: US 7,187,757 B2
(45) Date of Patent: Mar. 6, 2007

(54) COOLED RADIATION EMISSION DEVICE

(75) Inventors: Thomas Saint-Martin, Limours (FR); Jean-Christophe Claisse, Guyancourt (FR); Frédéric Dahan, Le Chesnay (FR); Gwénaël Lemarchand, Limours (FR)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/293,922

(22) Filed: Dec. 5, 2005

(65) Prior Publication Data

US 2006/0133577 A1 Jun. 22, 2006

(30) Foreign Application Priority Data

Dec. 21, 2004 (FR) ..... 04 53134

(51) Int. Cl.
*H01J 35/10* (2006.01)

(52) U.S. Cl. ..... 378/130; 378/133

(58) Field of Classification Search ..... 378/130, 378/133, 127, 141

See application file for complete search history.

(56) References Cited

U.S. PATENT DOCUMENTS

| | | | | |
|---|---|---|---|---|
| 3,719,847 | A | 3/1973 | Webster | |
| 4,943,989 | A | 7/1990 | Lounsberry et al. | |
| 4,949,369 | A * | 8/1990 | Bittl | 378/130 |
| 5,516,212 | A * | 5/1996 | Titcomb | 384/107 |
| 5,541,975 | A | 7/1996 | Anderson et al. | |
| 5,660,227 | A * | 8/1997 | Crowe | 165/47 |
| 5,737,387 | A | 4/1998 | Smither et al. | |
| 6,125,168 | A | 9/2000 | Bhatt | |
| 6,160,868 | A | 12/2000 | Snyder et al. | |
| 6,192,107 | B1 | 2/2001 | Price et al. | |
| 6,295,338 | B1 * | 9/2001 | Kuzniar et al. | 378/132 |
| 6,377,658 | B1 | 4/2002 | Vermilyea et al. | |
| 6,556,654 | B1 * | 4/2003 | Hansen et al. | 378/101 |
| 2002/0006183 | A1 * | 1/2002 | Ide | 378/133 |
| 2002/0050347 | A1 * | 5/2002 | Hainley et al. | 165/167 |
| 2003/0165217 | A1 | 9/2003 | Ratzman et al. | |

FOREIGN PATENT DOCUMENTS

| | | |
|---|---|---|
| DE | 100 17 777 A1 | 10/2001 |
| EP | 1 076 351 A1 | 2/2001 |
| JP | 5 258691 A1 | 10/1993 |

* cited by examiner

*Primary Examiner*—Edward J. Glick
*Assistant Examiner*—Chih-Cheng Glen Kao
(74) *Attorney, Agent, or Firm*—Cantor Colburn LLP

(57) ABSTRACT

A cooled radiation emission device has an enclosure in which X-rays are produced. In the enclosure, there is a cathode, an anode situated facing the cathode and rotating on a shaft, and a fixed anode shaft support. The support includes a holding chamber, the shaft of the anode being held in the chamber. The cooling of the tube uses a gallium-indium-tin liquid alloy flow through the anode shaft. This alloy is a conductor of heat and electricity. At the same time as the lubrication of the bearings and the electrical powering of the anode, it provides for cooling of the anode.

58 Claims, 3 Drawing Sheets

COOLED RADIATION EMISSION DEVICE

CROSS-REFERENCE TO RELATED APPLICATIONS

This application claims the benefit of a priority under 35 USC 119(a)–(d) to French Patent Application No. 04 53134 filed Dec. 21, 2004, the entire contents of which are hereby incorporated by reference.

BACKGROUND OF THE INVENTION

An embodiment of the present invention is a radiation emission device and more particularly, an X-ray tube. The embodiment can be used in medical imaging and also in the field of non-destructive controls when high-powered X-ray tubes are used. An embodiment of the invention is directed to cooling of such a device.

In radiology, X-rays are produced by an electron tube provided with an anode rotating on a shaft. A powerful electrical field created between the cathode and the anode enables electrons emitted by the cathode to strike the anode, generating X-rays. For this X-ray emission, the positive polarity is applied to the anode by the shaft, and the negative polarity is applied to the cathode. The unit is insulated especially by dielectric pieces or by an enclosure of the electron tube. This enclosure may be partly made of glass.

When the tube is used at high power, the impact of the electrons on the anode has the effect of abnormally heating this anode. If the power is excessively high, an emitter track of the anode may get deteriorated and pitted with impact holes. To prevent such overheating, the anode is made to rotate so that a constantly renewed and constantly cold surface is presented to the electron stream.

A motor of the tube therefore drives the shaft of the anode freely in a mechanical bearing. This shaft is located in an anode chamber. The anode chamber is itself formed in a support of the anode. On the one hand, the bearing is held by the anode support and, on the other hand, it holds the shaft of the anode.

In practice and when made on an industrial scale, this bearing comprises classic ball bearings as opposed to the little-used magnetic bearings. The problem posed by the rotating anodes arises from the fast wearing out of the metal coating the balls during the rotation of the shaft in the bearing. The service lifetime is then about 100 hours, giving a period of use of the tube of about six months to one year. To overcome this problem, it has been proposed to coat the bearings with metal, lead or silver in the form of a thin layer. To reduce this premature wearing out of the metal layer, a lubricant film is placed at the interface between the surfaces of the balls and the shaft, between the bearing and the shaft of the anode. To this end, the interior of the chamber is filled with a gallium-indium-tin based liquid. Such a liquid is chosen because it improves the coefficient of friction, reduces the noise of the impacts between the balls and augments heat transfer, due to the heating of the anode, to the fixed part, either by convection or by conduction. Other lubricant liquids are not chosen because they have poor degassing properties.

In current and future radiology the power needed by electron tubes is increasing in order to improve diagnosis. This increase in power is increasing the weight of the anode to six to eight kilograms. As a consequence, the resulting effects within the bearing are becoming critical. Furthermore, for use in computerized tomography with continuous rotation at two rotations per second, the bearing is subjected to acceleration of about eight G. Rotation speeds of three to four rotations per second are expected. Consequently, the service life of the bearing, and hence that of the tube, with the balls and the liquid, may be limited in time. Indeed, the liquid may lose its properties and therefore its qualities as and when heating and friction occur inside the bearing.

The use of a rotating anode must furthermore meet three main constraints. First, the rotation of the anode must be as free and as perfect as possible, and simple solutions of dynamic balancing must be planned to prevent the tube from vibrating when the anode rotates. Second, the anode must be capable of being taken to high voltage (normally, bearings with steel ball bearings serve this purpose). Third, the heat that is produced by the impact of the electrons on the anode target and propagates in the shaft must be efficiently discharged.

JP-A-5-258 691 describes an assembly in which ball bearings are lubricated by a gallium alloy. However, this assembly does not comply with the above constraints. Indeed, the balancing therein is difficult owing to the large diameter of the rotor, the thermal discharge is produced by a small-sized, fixed shaft, and there is nothing designed to improve the thermal and electrical conduction.

U.S. Pat. No. 6,125,168 describes for an X-ray tube, only the use of a gallium alloy to improve the thermal conduction. U.S. Pat. No. 6,160,868 also provides for improving the thermal conductivity with a gallium alloy. U.S. Pat. No. 6,377,658 is of the same type, and so is U.S. Pat. No. 6,192,107. U.S. Pat. No. 4,943,989 provides for the cooling of the anode itself. For thermal reasons, U.S. Pat. No. 3,719,847 provides for a liquid metal that evaporates and then returns to the liquid state. US 2003-0165217 provides only for a thermal shunt.

In any case, the cooling of the tube is a problem since it dictates the making of bigger tubes whereas, for reasons of handling, it is sought rather to make smaller tubes.

BRIEF DESCRIPTION OF THE INVENTION

An embodiment of the invention therefore is a radiation emission device, such as an X-ray tube comprising: an enclosure in which the radiation is produced and means for cooling the device. In the enclosure, a cathode, an anode situated facing the cathode and rotating on a shaft, and a fixed anode shaft support. The support comprises a holding chamber and, in this chamber, a ball bearing. The shaft of the anode is held in the chamber by the bearing. The chamber of the support is filled with a gallium-indium-tin liquid alloy in which the bearing is immersed. The means for cooling the device has a circuit to cause the liquid alloy to penetrate the chamber and cause it come out during a use of the tube.

BRIEF DESCRIPTION OF THE DRAWINGS

An embodiment of the invention will be understood more clearly from the following description and the accompanying figures. These figures are given purely by way of an indication and in no way restrict the scope of the invention. Of these figures.

DETAILED DESCRIPTION OF THE INVENTION

In an embodiment of the invention a metal liquid alloy flows through the anode. Thus, the alloy enters a chamber of an anode support, therein cools the bearings and the shaft, and ultimately cools the anode. A volume of the alloy is extracted from the chamber at the same time as it is replaced by another colder volume. This mode of action, performed during a use of the tube, i.e., while the X-rays are being produced, increases the quantity of alloy contributing to the cooling process without increasing the weight of the rotating part, i.e., the weight of the anode and/or of its shaft, and without increasing the size of the tube. The mass heated up by the X-rays is thus greater, without any consequences in terms of acceleration, balancing and concomitant wear in the bearings. In particular, the alloy is a gallium-indium-tin alloy.

Another embodiment of the invention provides that the totality of the shaft will bathe in the liquid metal alloy, the tight sealing of the chamber being produced by a tight-sealing device placed at the shaft exit. In another embodiment, the anode shaft is longitudinally hollow. The anode shaft then rests on bearings present in two separate chambers, on either side of this shaft. The liquid alloy flows in the shaft and cools it throughout its length.

Figure 1B:
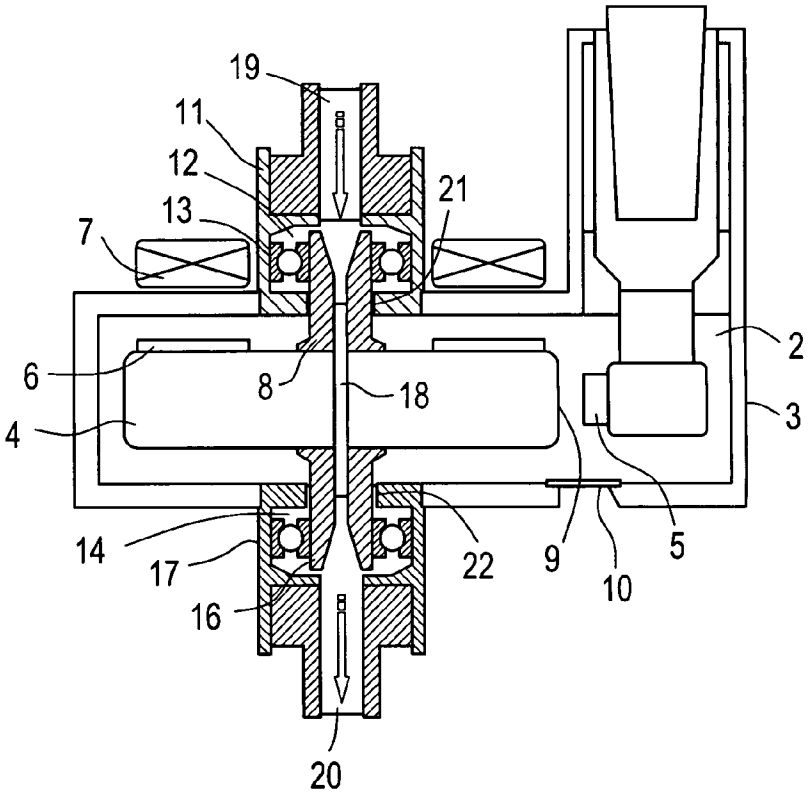
FIGS. 1*a* and 1*b* are two schematic sectional views of two variants of an X-ray tube embodiment of the invention.
Figure 1A:
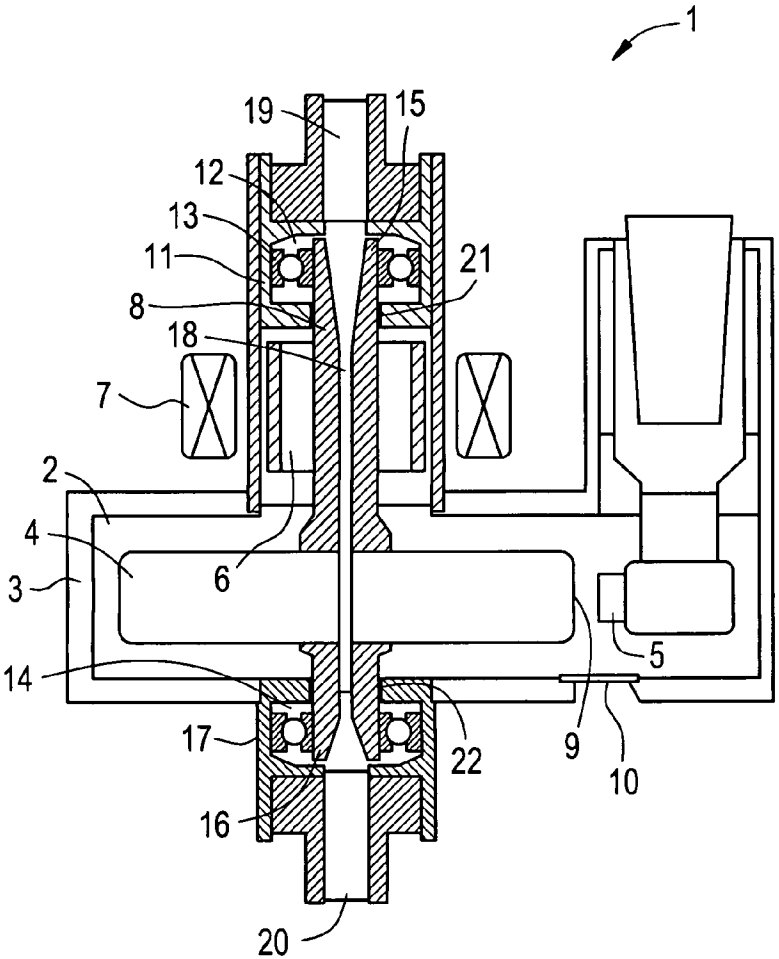

FIGS. 1*a* and 1*b* show an X-ray tube 1 according to an embodiment of the invention. The tube 1 has an enclosure 2. For example, the enclosure 2 is the one delimited by a wall 3 of the tube 1. The tube 1 also has a rotating anode 4. The rotating anode 4 is situated so as to be facing a cathode 5. Inside the enclosure 2 of the tube 1, there is a motor 6 for the rotational driving of the anode 4. A stator 7 of this motor is situated facing the rotor, outside the enclosure 2. The anode 4 has an anode shaft 8. The cathode 5 is situated so as to be facing an anode track 9. When the anode 4 is powered with high voltage, electrons are liberated from the cathode 5 and, under the effect of a powerful electrical field, they strike the anode track 9. Under the effect of this impingement, the anode track 9, which is formed by an X-ray emitting material, emits X-rays. The X-rays exit from the tube 1 through a window 10 made in the wall 3. The window 10 is made, for example, of glass or an X-ray transparent material. It is airtight. The enclosure 2 thus formed is put under vacuum conventionally, in particular through a suction hole (not shown) subsequently blocked by a stemming.

To keep the anode 4 rotating, the tube 1 is provided with an anode support 11 made of metal. This support 11 is hollow and has a chamber 12. In the chamber 12, bearings such as 13 maintain the anode 4 by the support 11 by resting respectively on the support 11 and the shaft 8. To resolve the problems of lubrication and of the transportation of heat during the rotation of the anode 4, the chamber 12 may be filled with a gallium-indium-tin liquid alloy. Thus, the bearing 13 is immersed in the liquid alloy. The gallium-indium-tin liquid alloy then plays a multiple role. First, it lubricates the balls of the bearing 13. Second, it provides for efficient electrical connection of the anode to a potential dictated by the support 11. Third, the liquid alloy cools the anode in tapping the heat that is produced at the anode 4 and gets propagated in its shaft 8, communicating it to the support.

In an embodiment of the invention, the means for cooling is provided by a circulation of the liquid alloy. A circuit or conduit is provided to cause the liquid alloy to penetrate the chamber 12 and cause it to come out from this chamber. This circuit is active during the use of the tube. In the several embodiments shown, this circuit comprises two chambers, the chamber 12 and the chamber 14. The two chambers 12 and 14 are made at the position of two ends respectively 15 and 16 of the shaft 8. To this end, the chamber 14 is made in a second support 17. The two supports 11 and 17 are fixed to the wall 3. For example, the chamber 12 serves as a liquid alloy inlet chamber, the chamber 14 serving as an outlet chamber.

To pass from one chamber to the other, the liquid alloy may take an ancillary conduit. The efficiency of the heat transfer can be improved if the shaft 8 is hollow. The shaft 8 then serves as an ancillary conduit. To this end, the shaft 8 has a longitudinal bore 18, throughout its length. The bore 18 opens out into each of the chambers 12 and 14 by its ends. The chambers 12 and 14 therefore have ports 19 and 20 to let in the liquid alloy and take it out respectively.

It is possible to have only one chamber in only one support. In this case, this single support would carry all the bearings and have both ports, for letting in and removing the liquid alloy.

The shaft 8 has a shaft exit 21 and 22 respectively at the exit from each of the chambers 12 and 14. So that the liquid alloy does not flow through these exits 21 and 22, tight sealing is obtained in two complementary ways. Firstly, for the vacuum tightness, when the anode shaft does not rotate, a space is delimited between an inner diameter of the support 11 or 17 and an outer diameter of the shaft 8, at the position vertical to these exits 21 or 22. The boundary of this space is fixed by the surface tension of the gallium-indium-tin liquid metal alloy on the material of the shaft 8 and of the supports 11 and 17. It can be seen that this alloy has low wetness and the surface tension provides clearance of about a hundredth of a millimeter, propitious to efficient rotation of the shaft 8, and furthermore easy to comply with in industrial-scale conditions. The supports 11 and 17 are fixed when the shaft 8 rotates. When the shaft 8 rotates, the pressure of the liquid alloy increases. The alloy tends to escape from the chamber 12 and contaminate the enclosure 2 of the tube. In this case, to confine the alloy inside the chamber 12, it is planned to provide the surface of the surface 11 that is in contact, or the surface of the shaft 8 in the region vertical to the exit 21, with a helical relief feature. The pitch of the helix is oriented so that, for a given sense of rotation of the shaft 8, the helical relief, before the surface pointed toward it, behaves like a scraper. Such a scraper tends to push the alloy back into the chamber 12. The same feature can be implemented, if need be, for the chamber 14.

In the variant of FIG. 1*a*, the rotor 6 is fixed along the anode shaft 8. The overall dimension of the tube is greater, but the thermal transfer with the anode shaft is more efficient because the length of the shaft in contact with the liquid alloy is greater. In the variant of FIG. 1*b*, the structure is more compact. In this second case the rotor 6 is fixed to the anode disk. In both cases, the poles of the stator are presented so as to be facing the path taken by the poles of the rotor. In the case of the variant of FIG. 1*a*, the rotor is situated in the support 11. In the case of the variant of FIG. 1*b*, it is directly situated in the enclosure 2.

Figure 2:
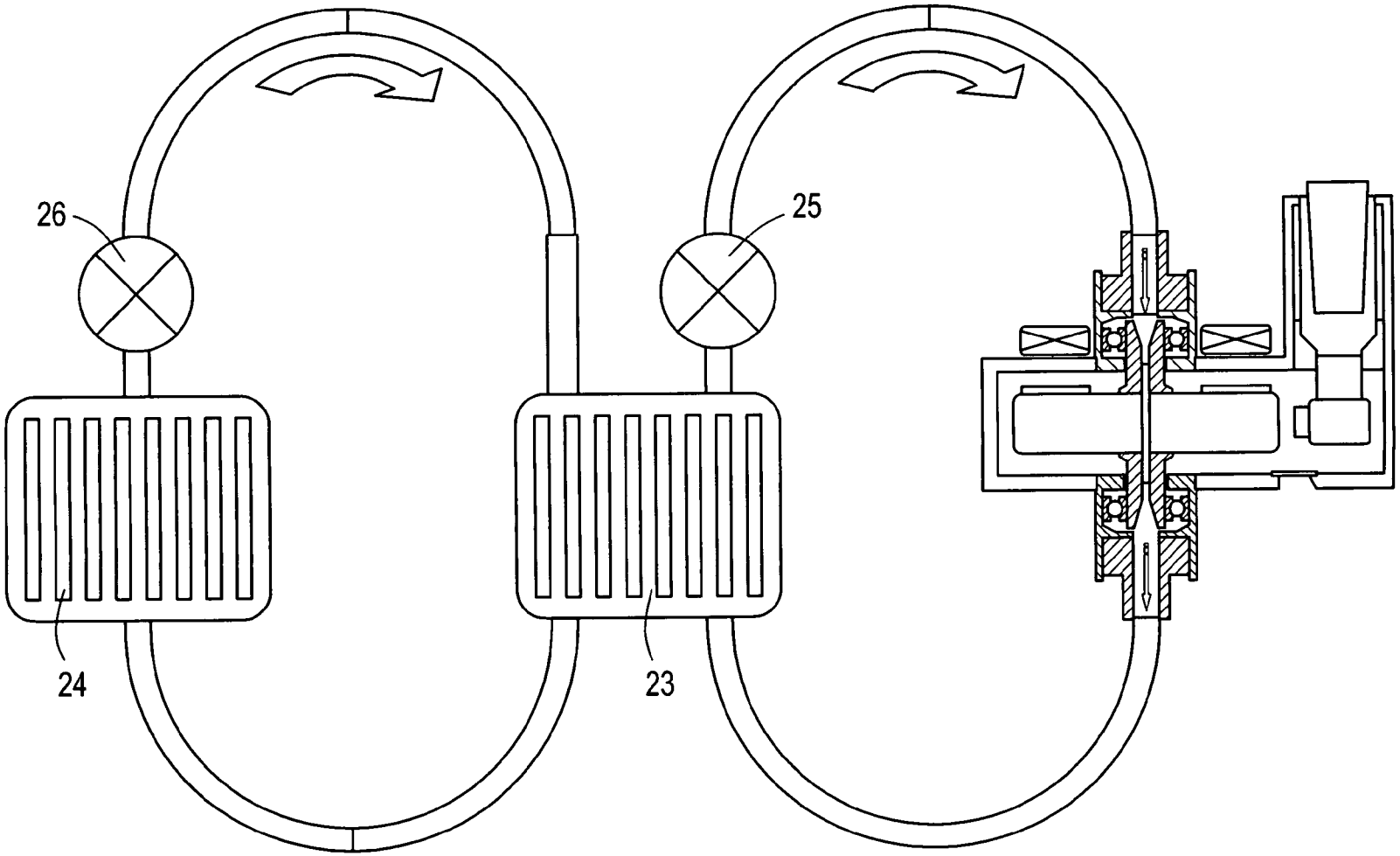
FIG. 2 is a schematic view of another embodiment of the invention.

FIG. 2 shows an embodiment in which the liquid alloy is taken up to a heat exchanger 23. In this exchanger 23, the gallium-indium-tin based liquid alloy yields its heat to another fluid, for example water. The exchanger 23 may be made, for example, of an electrically insulating material, for example ceramic. In this case, a more efficient solution to the insulation of the X-ray tube may be proposed. If necessary, the potential of the anode may be different from the ground potential and may be taken to a high voltage. The other fluid that flows in the exchanger 23 may be cooled by a heat sink 24, itself cooled by air. Pumps 25 and 26 force the circulation of these fluids in their different networks.

Figure 3:
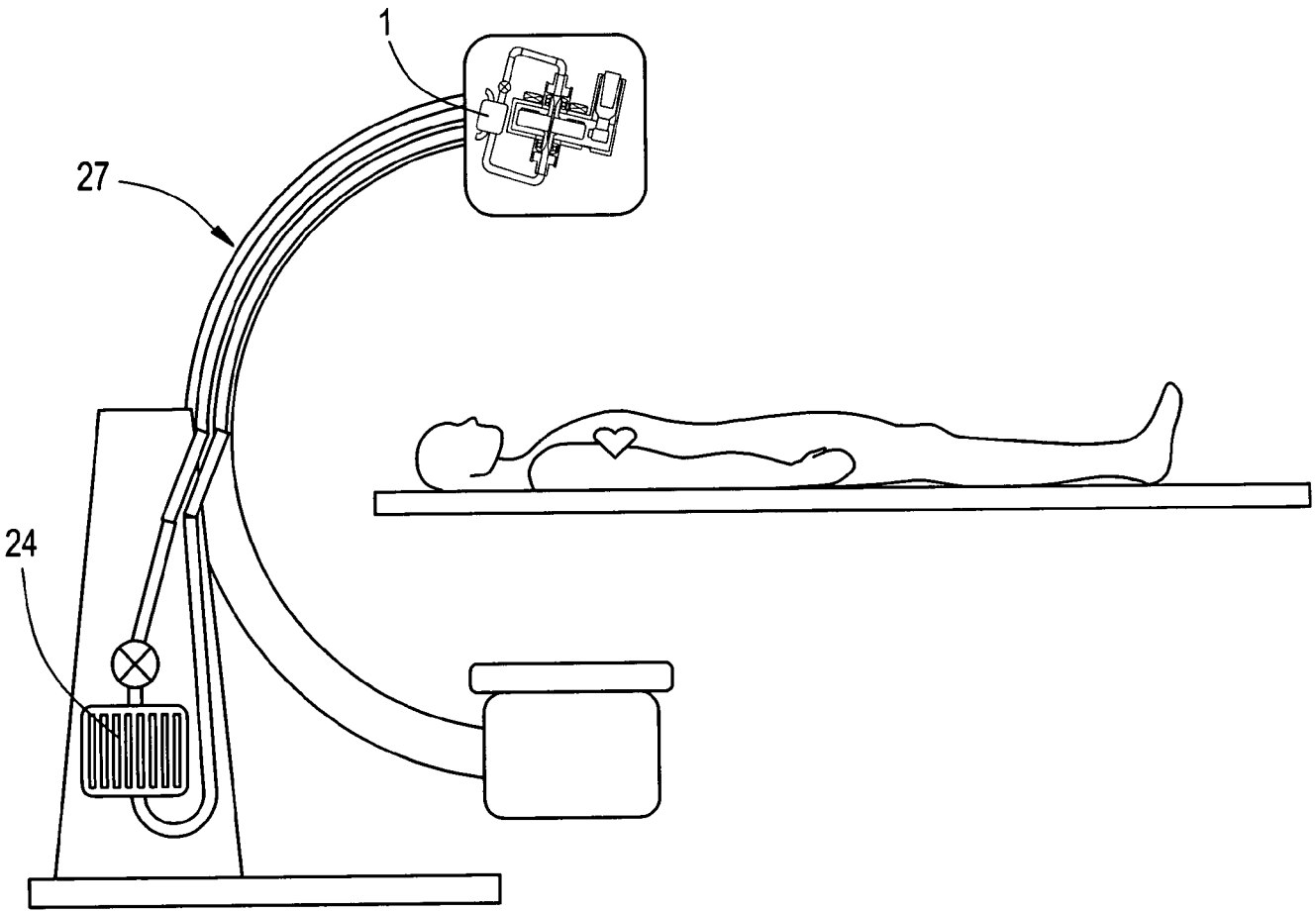
FIG. 3 shows a mode of use of an embodiment of the invention.

FIG. 3 gives a view, in a medical use, of an isocentric C-arm 27 provided with an X-ray tube with cooling as disclosed. In FIG. 3 the exchanger 23 is placed in a moving element of the stator while a heat sink 24 is placed at a base of the C-arm 27, where there is a great deal of space and where air cooling can be set up without inconveniencing the patient (through the ventilation noise caused).

In addition, while an embodiment of the invention has been described with reference to exemplary embodiments, it will be understood by those skilled in the art that various changes may be made in the function and/or way and/or result and equivalents may be substituted for elements thereof without departing from the scope and extent of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element or feature from another. Furthermore, the use of the terms a, an, etc. do not denote a limitation of quantity, but rather denote the presence of at least one of the referenced element or feature.

What is claimed is:

1. A radiation emission device comprising:

an enclosure in which radiation is produced;

in the enclosure, comprising a cathode, an anode situated facing the cathode and rotating on a shaft, and a fixed anode shaft support;

the support comprising a holding chamber and, in this chamber, a ball bearing;

the shaft of the anode being held in the chamber by the bearing;

the chamber of the support being filled with a liquid alloy in which the bearing is immersed; and means for cooling by causing the liquid alloy to penetrate the chamber and to come out of the chamber during a use of the device.

2. The device according to claim 1 wherein:

the device comprises two chambers;

the anode shaft is hollow and is held in one of these two chambers at each of the two ends of the anode shaft; and one chamber serving as an inlet chamber for the liquid alloy of the means for cooling, the other chamber serving as an outlet chamber for the liquid alloy of the means for cooling.

3. The device according to claim 1 comprising:

means for tight-sealing at a shaft exit to prevent leakage of alloy out of the chamber.

4. The device according to claim 2 comprising:

means for tight-sealing at shaft exits to prevent leakage of alloy out of the chambers.

5. The device according to claim 1 comprising:

a motor to drive the shaft, a rotor of the motor being inside the chamber or the enclosure and driving the anode; and a stator being outside the chamber or the enclosure, the rotor being fixed along the anode shaft, the stator being placed facing the rotor.

6. The device according to claim 2 comprising:

a motor to drive the shaft, a rotor of the motor being inside one of the chambers or the enclosure and driving the anode; and a stator being outside one of the chambers or the enclosure, the rotor being fixed along the anode shaft, the stator being placed facing the rotor.

7. The device according to claim 3 comprising:

a motor to drive the shaft, a rotor of the motor being inside the chamber or the enclosure and driving the anode; and a stator being outside the chamber or the enclosure, the rotor being fixed along the anode shaft, the stator being placed facing the rotor.

8. The device according to claim 1 comprising:

a motor to drive the shaft, a rotor of the motor being inside the enclosure and driving the anode; and a stator being outside the enclosure, the rotor being fixed against an anode disk, the stator being placed facing the rotor.

9. The device according to claim 2 comprising:

a motor to drive the shaft, a rotor of the motor being inside the enclosure and driving the anode; and a stator being outside the enclosure, the rotor being fixed against an anode disk, the stator being placed facing the rotor.

10. The device according to claim 3 comprising:

a motor to drive the shaft, a rotor of the motor being inside the enclosure and driving the anode; and a stator being outside the enclosure, the rotor being fixed against an anode disk, the stator being placed facing the rotor.

11. The device according to claim 4 comprising:

a motor to drive the shaft, a rotor of the motor being inside the enclosure and driving the anode; and a stator being outside the enclosure, the rotor being fixed against an anode disk, the stator being placed facing the rotor.

12. The device according to claim 5 comprising:

a motor to drive the shaft, a rotor of the motor being inside the enclosure and driving the anode; and a stator being outside the enclosure, the rotor being fixed against an anode disk, the stator being placed facing the rotor.

13. The device according to claim 1 comprising:

a heat exchanger to transfer heat from the liquid alloy to another fluid.

14. The device according to claim 2 comprising:

a heat exchanger to transfer heat from the liquid alloy to another fluid.

15. The device according to claim 3 comprising:

a heat exchanger to transfer heat from the liquid alloy to another fluid.

16. The device according to claim 4 comprising:

a heat exchanger to transfer heat from the liquid alloy to another fluid.

17. The device according to claim 5 comprising:

a heat exchanger to transfer heat from the liquid alloy to another fluid.

18. The device according to claim 8 comprising:

a heat exchanger to transfer heat from the liquid alloy to another fluid.

19. The device according to claim 13 wherein the heat exchanger comprises an electrical insulation device and wherein the other fluid is an electrically insulating fluid.

20. The device according to claim 14 wherein the heat exchanger comprises an electrical insulation device and wherein the other fluid is an electrically insulating fluid.

21. The device according to claim 15 wherein the heat exchanger comprises an electrical insulation device and wherein the other fluid is an electrically insulating fluid.

22. The device according to claim 16 wherein the heat exchanger comprises an electrical insulation device and wherein the other fluid is an electrically insulating fluid.

23. The device according to claim 17 wherein the heat exchanger comprises an electrical insulation device and wherein the other fluid is an electrically insulating fluid.

24. The device according to claim 18 wherein the heat exchanger comprises an electrical insulation device and wherein the other fluid is an electrically insulating fluid.

25. The device according to claim 1 having an electrical ground, wherein the anode is taken to the potential of this electrical ground.

26. The device according to claim 2 having an electrical ground, wherein the anode is taken to the potential of this electrical ground.

27. The device according to claim 3 having an electrical ground, wherein the anode is taken to the potential of this electrical ground.

28. The device according to claim 4 having an electrical ground, wherein the anode is taken to the potential of this electrical ground.

29. The device according to claim 5 having an electrical ground, wherein the anode is taken to the potential of this electrical ground.

30. The device according to claim 8 having an electrical ground, wherein the anode is taken to the potential of this electrical ground.

31. The device according to claim 19 having an electrical ground, wherein the anode is taken to the potential of this electrical ground.

32. The device according to claim 1 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

33. The device according to claim 2 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

34. The device according to claim 3 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

35. The device according to claim 4 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

36. The device according to claim 5 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

37. The device according to claim 8 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

38. The device according to claim 19 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

39. The device according to claim 25 wherein at the position of an exit of the anode shaft out of the support, the support has an opposition of two concentric surfaces, one surface attached to the shaft, another surface attached to the support, the surface attached to the shaft being situated inside the surface attached to the support, a clearance between these two surfaces being smaller than a clearance of natural flow of the alloy owing to the surface tension of this alloy.

40. The device according to claim 1 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

41. The device according to claim 2 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into at least one of the chambers when the anode rotates.

42. The device according to claim 3 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

43. The device according to claim 4 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into at least one of the chambers when the anode rotates.

44. The device according to claim 5 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

45. The device according to claim 8 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

46. The device according to claim 19 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

47. The device according to claim 25 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

48. The device according to claim 32 wherein, at the position of an exit of the anode shaft out of the support, the support has an opposition of two concentric surfaces, one surface attached to the shaft, another surface attached to the support, the surface attached to the shaft being situated inside the surface attached to the support, one of these surfaces being provided with a helical relief feature or a spiral relief feature, for which the orientation of the pitch is such that it pushes the alloy into the chamber when the anode rotates.

49. The device according to claim 1 wherein the liquid alloy is gallium-indium-tin.

50. The device according to claim 2 wherein the liquid alloy is gallium-indium-tin.

51. The device according to claim 3 wherein the liquid alloy is gallium-indium-tin.

52. The device according to claim 4 wherein the liquid alloy is gallium-indium-tin.

53. The device according to claim 5 wherein the liquid alloy is gallium-indium-tin.

54. The device according to claim 8 wherein the liquid alloy is gallium-indium-tin.

55. The device according to claim 19 wherein the liquid alloy is gallium-indium-tin.

56. The device according to claim 25 wherein the liquid alloy is gallium-indium-tin.

57. The device according to claim 32 wherein the liquid alloy is gallium-indium-tin.

58. The device according to claim 40 wherein the liquid alloy is gallium-indium-tin.

* * * * *